US010328719B2

(12) United States Patent
Kobashi et al.

(10) Patent No.: US 10,328,719 B2
(45) Date of Patent: Jun. 25, 2019

(54) LIQUID EJECTING APPARATUS

(71) Applicant: SEIKO EPSON CORPORATION, Tokyo (JP)

(72) Inventors: Masaru Kobashi, Matsumoto (JP); Izumi Nozawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/171,547

(22) Filed: Jun. 2, 2016

(65) Prior Publication Data

US 2016/0375702 A1 Dec. 29, 2016

(30) Foreign Application Priority Data

Jun. 26, 2015 (JP) ..... 2015-128824

(51) Int. Cl.
*B41J 2/165* (2006.01)
*B41J 11/00* (2006.01)

(52) U.S. Cl.
CPC ..... *B41J 11/002* (2013.01); *B41J 2/16508* (2013.01); *B41J 2/16523* (2013.01); *B41J 2/16535* (2013.01); *B41J 2002/1655* (2013.01)

(58) Field of Classification Search
None
See application file for complete search history.

(56) References Cited

U.S. PATENT DOCUMENTS 5,216,442 A * 6/1993 Parks ..... B41J 11/0085 346/104
6,183,060 B1 * 2/2001 Tokuda ..... B41J 2/16535 347/29
7,922,295 B2 * 4/2011 Kawai ..... B41J 2/06 347/22
2002/0044168 A1 4/2002 Hashi et al.
2005/0093919 A1 5/2005 Takatsuka et al.
2011/0050825 A1 * 3/2011 Murata ..... B41J 11/007 347/104
2011/0057990 A1 * 3/2011 Heo ..... B41J 2/16547 347/33
2012/0105523 A1 * 5/2012 Kakigahara ..... B41J 2/16505 347/9
2013/0258017 A1 10/2013 Kagose et al.
(Continued)

FOREIGN PATENT DOCUMENTS

JP 02-266949 A 10/1999
JP 2001-334647 A 12/2001
JP 2002-120386 A 4/2002
(Continued)

*Primary Examiner* — Matthew Luu
*Assistant Examiner* — Tracey M McMillion
(74) *Attorney, Agent, or Firm* — Workman Nydegger

(57) ABSTRACT

A liquid ejecting apparatus includes a medium supporting unit which supports a medium that is transported along a transport path; a liquid ejecting head which includes a nozzle for ejecting liquid onto a medium that is supported by the medium supporting unit; a heating part which heats the medium; and a space forming member which forms a closed space at which the nozzle is opened. The space forming member is configured to move between a space forming position in which the space forming member is disposed when forming the closed space, and a retracted position which is further separated from the heating part than the space forming position.

10 Claims, 8 Drawing Sheets

(56) References Cited

U.S. PATENT DOCUMENTS

| | | | | |
|---|---|---|---|---|
| 2014/0210904 | A1* | 7/2014 | Takahashi | B41J 2/16511 347/29 |
| 2016/0031232 | A1 | 2/2016 | Kagose et al. | |

FOREIGN PATENT DOCUMENTS

| | | | |
|---|---|---|---|
| JP | 2005-119283 | A | 5/2005 |
| JP | 2013-154490 | A | 8/2013 |
| JP | 2013-202928 | A | 10/2013 |

* cited by examiner

LIQUID EJECTING APPARATUS

BACKGROUND

1. Technical Field

The present invention relates to a liquid ejecting apparatus which dries a medium by applying heat.

2. Related Art

In the related art, an image forming device which is described in, for example, JP-A-2005-119283 is proposed as a liquid ejecting apparatus of this type. The image forming device includes a liquid ejecting head which forms an image on a medium that is transported along a predetermined transport path, and a drying unit which is disposed on a downstream side of the liquid ejecting head in transport direction. Multiple nozzles which are opened in a nozzle forming surface are provided in the liquid ejecting head, and liquid such as ink is ejected from the nozzle onto the medium. In addition, the drying unit heats a medium thereby drying the medium to which liquid is attached. In this way, the medium to which liquid is attached is forcibly dried by the drying unit, and thus, it is possible to prevent liquid from being attached to various components such as a roller which is disposed in the transport path through the medium.

However, in the aforementioned liquid ejecting apparatus, various types of maintenance is performed to prevent liquid ejection accuracy of a liquid ejecting head from decreasing. A maintenance member which is used for the maintenance can be configured to be able to move between a working position around the liquid ejecting head and a retracted position separated from the liquid ejecting head. A space forming member such as a cap which forms a closed space at which a nozzle of the liquid ejecting head is opened, an absorbing member which absorbs liquid attached to the liquid ejecting head, a wiping member which wipes an area in the liquid ejecting head at which the nozzle is opened, or the like can be used as the maintenance member.

In addition, JP-A-2005-119283 does not disclose or suggest the disposition of the drying unit and a positional relationship between the drying unit and a retracted position of the maintenance member.

SUMMARY

An advantage of some aspects of the invention is to provide a liquid ejecting apparatus which can set a retracted position of a maintenance member to an appropriate position in which disposition of a drying unit is considered.

According to an aspect of the invention, a liquid ejecting apparatus includes a medium supporting unit which supports a medium that is transported along a transport path; a liquid ejecting head which includes a nozzle for ejecting liquid onto a medium that is supported by the medium supporting unit; a drying unit which dries the medium to which liquid is attached by applying heat; and a space forming member which forms a closed space at which the nozzle is opened. The space forming member is configured to move between a space forming position in which the space forming member is disposed when forming the closed space, and a retracted position which is further separated from the drying unit than the space forming position.

According to the configuration, it is possible to form the closed space at which the nozzle is opened by disposing the space forming member different from the medium supporting unit in the space forming position. In addition, it is possible to prevent liquid in the nozzle from evaporating, and to prevent viscosity of liquid in the nozzle from increasing, by retaining liquid for moisturizing in the space forming member thereby maintaining high humidity in the closed space. In addition, it is possible to perform cleaning which forcibly discharges liquid into the closed space.

Here, in order to prevent the viscosity of the liquid in the nozzle from increasing, it is preferable that, while the space forming member is located at the retracted position, the liquid retained in the space forming member does not evaporate. At this point, in the aforementioned configuration, the retracted position of the space forming member is further separated from the drying unit than the space forming position. For this reason, while the space forming member is located at the retracted position, the space forming member is hardly affected by the heat which is emitted from the drying unit, and the liquid retained in the space forming member is prevented from evaporating. Accordingly, in a case where the space forming member moves to the space forming position to form the closed space, the humidity in the closed space can be increased by the liquid retained in the space forming member. As a result, the liquid in the nozzle hardly evaporates, and an increase of the viscosity of the liquid in the nozzle is easily prevented. Hence, it is possible to set the retracted position of the space forming member which is an example of a maintenance member to an appropriate position in which disposition of the drying unit is considered.

According to another aspect of the invention, a liquid ejecting apparatus includes a liquid ejecting head which includes a nozzle for ejecting liquid onto a medium that is transported along a transport path; a drying unit which dries the medium to which liquid is attached by applying heat; and an absorbing member which absorbs liquid that is attached to the liquid ejecting head. The absorbing member is configured to move between a contact position in which the absorbing member comes into contact with the liquid ejecting head, and a retracted position which is separated from the liquid ejecting head and is closer to the drying unit than the contact position.

According to the configuration, as the absorbing member comes into contact with the liquid ejecting head, the liquid attached to the liquid ejecting head can be absorbed by the absorbing member. Then, the absorbing member which absorbs the liquid from the liquid ejecting head moves to the retracted position from the contact position.

Here, in order to prevent liquid absorption efficiency of the absorbing member from decreasing, it is preferable that the amount of liquid contained in the absorbing member is extremely reduced. At this point, in the aforementioned configuration, the retracted position of the absorbing member is set closer to the drying unit than the contact position. For this reason, when the absorbing member is located at the retracted position, the liquid easily evaporates from the absorbing member due to being affected by heat which is emitted from the drying unit. As a result, the amount of liquid contained in the absorbing member is reduced at a point of time when the absorbing member moves to the contact position, and the liquid attached to the liquid ejecting head is easily absorbed by the absorbing member. Hence, it is possible to set the retracted position of the absorbing member which is an example of a maintenance member to an appropriate position in which disposition of the drying unit is considered.

According to still another aspect of the invention, a liquid ejecting apparatus includes a liquid ejecting head which includes a nozzle for ejecting liquid onto a medium that is transported along a transport path; a drying unit which dries the medium to which liquid is attached by applying heat; and a wiping member in a wet state which wipes an area in the liquid ejecting head at which the nozzle is opened by relatively moving with respect to the liquid ejecting head. The wiping member is configured to move between a wiping position in which the wiping member is disposed when wiping the area, and a retracted position which is further separated from the liquid ejecting head and the drying unit than the wiping position.

According to the configuration, it is possible to wipe an area in a liquid ejecting head at which the nozzle is opened by relatively moving the wiping member with respect to the liquid ejecting head. In addition, if the area is completely wiped, the wiping member moves from the wiping position to the retracted position.

Here, in order to prevent wiping performance to the area of the wiping member from decreasing, it is preferable that a wet state of the wiping member is maintained. At this point, in the aforementioned configuration, the retracted position of the wiping member is further separated from the drying unit than the contact position. For this reason, when the wiping member is located at the retracted position, the wiping member is hardly affected by the heat which is emitted from the drying unit, and the wet state of the wiping member is easily maintained. As a result, it is possible to prevent the wiping performance to the area of the wiping member from decreasing. Hence, it is possible to set the retracted position of the wiping member which is an example of a maintenance member to an appropriate position in which disposition of the drying unit is considered.

In the liquid ejecting apparatus, it is preferable that the medium supporting unit is configured to move between a support position below the liquid ejecting head in which the medium supporting unit supports the medium that is transported and a retracted position which is separated from the transport path, when the medium supporting unit is disposed in the support position and the medium supporting unit supports the medium liquid which is ejected from the nozzle is attached to the medium, the drying unit is disposed above the support position, and a retracted position of the space forming member is set to be below the support position.

According to the configuration, when the space forming member moves to the space forming position, the medium supporting unit moves from the support position to the retracted position. In addition, if the space forming member moves to the space forming position in this state, the closed space is formed.

In addition, in the configuration, the drying unit is disposed above the support position of the medium supporting unit, and the retracted position of the space forming member is below the support position of the medium supporting unit. For this reason, when the medium supporting unit is located at the support position, warm air which is heated by the drying unit and flows toward the space forming member located at the retracted position can be blocked by the medium supporting unit. Hence, it is possible to prevent the liquid which is retained in the space forming member from evaporating, when the space forming member is located at the retracted position.

In the liquid ejecting apparatus, it is preferable that the transport path is configured such that the medium passes through a region between the retracted position and the drying unit.

According to the configuration, when a medium is transported along the transport path, the medium passes through a region between the space forming member located at the retracted position and the drying unit. For this reason, flowing of gas can be blocked by the medium which is transported along the transport path, such that air heated by the drying unit does not flow toward the space forming member located at the retracted position. Hence, it is possible to increase effects in which liquid retained in the space forming member is prevented from evaporating, when the space forming member is located at the retracted position.

In the liquid ejecting apparatus, it is preferable that the drying unit is disposed above an opening of the nozzle.

Air which is warmed by heat that is emitted from the drying unit easily moves toward an upper side. At this point, in the aforementioned configuration, the opening of the nozzle is located below the drying unit, and thus, the warmed air is hardly introduced into the nozzle through the opening. Hence, it is possible to prevent liquid in the nozzle from evaporating.

It is preferable that the liquid ejecting apparatus further includes a control unit which controls the drying unit, and the control unit performs heating using the drying unit, under the condition that the amount of liquid which is ejected from the nozzle onto the medium is equal to or larger than a threshold.

According to the configuration, when the amount of liquid attached to a medium is small, it can be determined that the medium may not be heated by the drying unit, and thus, the medium is not heated by the drying unit. For this reason, it is possible to prevent a drive frequency of the drying unit from increasing, and thus, it is possible to prevent power consumption of the liquid ejecting apparatus from increasing.

It is preferable that the liquid ejecting apparatus further includes a mounting unit in which a liquid container that contains liquid which is supplied to the liquid ejecting head is mounted, and the mounting unit is disposed such that at least a part of the liquid container which is mounted in the mounting unit is located immediately above the drying unit.

According to the configuration, air heated by the drying unit moves toward an upper side. Then, the temperature of liquid in the liquid container which is mounted in the mounting unit is increased by the heated air. In this way, as the temperature of the liquid increases, viscosity of the liquid decreases. Hence, even when a liquid has high viscosity, the liquid can be stably supplied from the liquid container to the liquid ejecting head.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, a first embodiment in which a liquid ejecting apparatus is embodied will be described with reference to FIG. 1 to FIG. 5.

Figure 1:
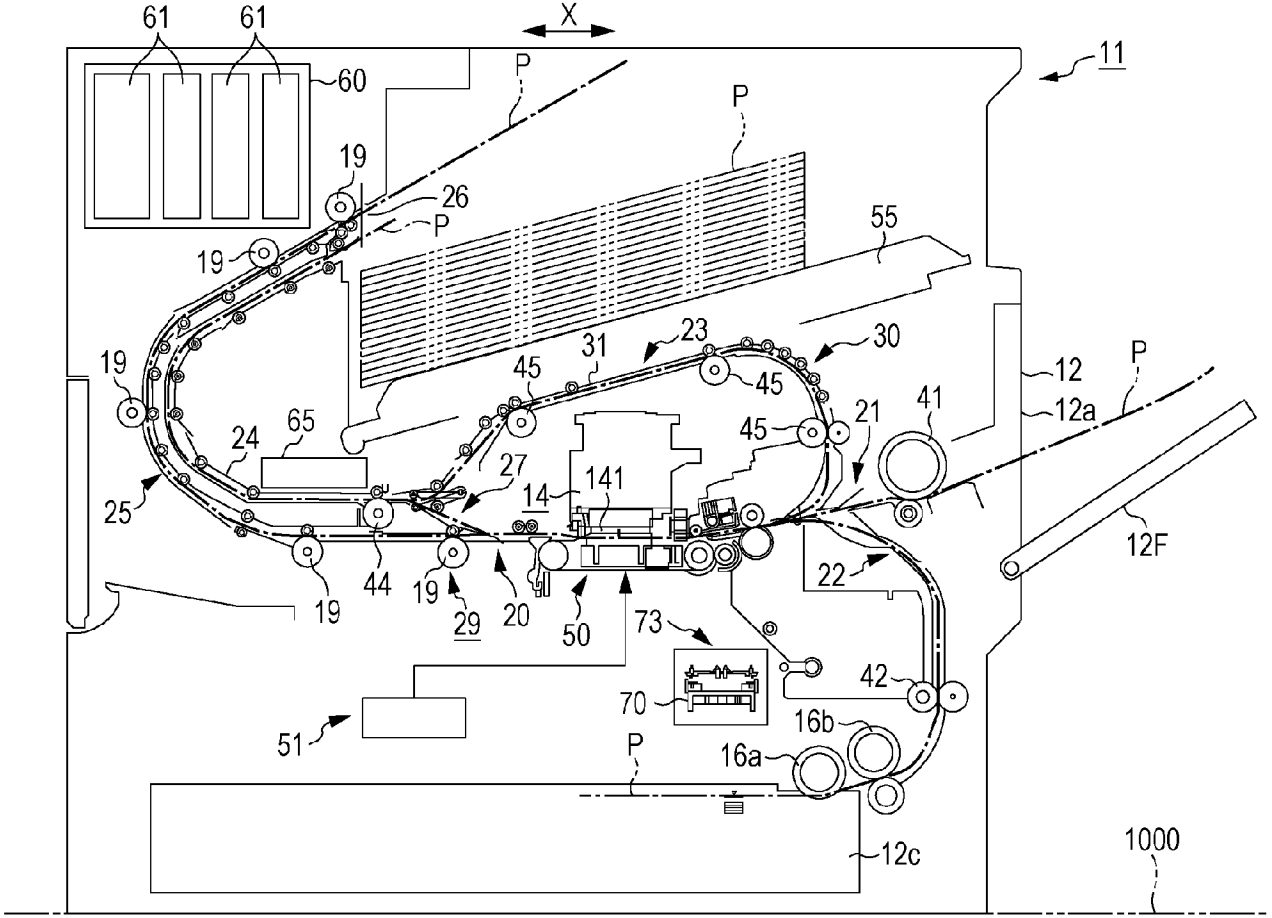
FIG. 1 is a schematic configuration view of a printer as a first embodiment of a liquid ejecting apparatus.

As described in FIG. 1, a transport device 29 which transports paper P that is an example of a medium is transported along a transport path 20, and a print unit 14 which performs printing on the paper P that is transported, are provided in a case 12 of a printer 11 which is an example of the liquid ejecting apparatus. In a case where a direction orthogonal to a paper surface is set to a width direction of the paper in FIG. 1, the transport path 20 is formed such that the paper P is transported in a direction orthogonal to the width direction of the paper, preferably, a direction orthogonal to the width direction.

The print unit 14 includes a print head 141 of an ink jet type which can simultaneously eject ink that is an example of liquid over approximately the entire area in the width direction of the paper. The print head 141 corresponds to an example of a "liquid ejecting head". In addition, the ink which is ejected from the print head 141 is attached to the paper P, and thus, an image is formed on the paper P. The print head 141 which is provided in the printer 11 according to the present embodiment is a head which ejects pigment ink that is ink which contains pigment particles. Of course, the print head may be a head which ejects dye ink.

A mounting unit 60 in which multiple liquid containers 61 that contain ink are detachably mounted is provided on an upper side (upper left in FIG. 1) in the case 12. Specifically, the mounting unit 60 is disposed on an upper side further than the print unit 14. Ink is supplied to the print head 141 through a supply path 62 (refer to FIG. 5) from the liquid container 61 which is mounted in the mounting unit 60.

The transport device 29 includes a discharge mechanism 25 which discharges the printed paper P outside the case 12, and a feeding mechanism 30 which feeds the paper P which is not printed along the transport path 20.

The discharge mechanism 25 includes multiple discharge roller pairs 19 which are disposed along the transport path 20. The paper P which is transported by the discharge mechanism 25 is discharged outside the case 12 from a medium outlet 26 which is formed in the case 12. That is, the medium outlet 26 is a downstream end of the transport path 20. In addition, the paper P which is discharged from the medium outlet 26 is mounted on a mounting table 55 in a stacked state, as illustrated by a two-dot chain line in FIG. 1.

The feeding mechanism 30 includes a first medium supply unit 21, a second medium supply unit 22, a third medium supply unit 23, and an electrostatic transport unit 50. The electrostatic transport unit 50 is disposed immediately below the print unit 14 in FIG. 1. A charging belt to which the paper P is adsorbed is provided in the electrostatic transport unit 50, the charging belt moves, and thereby the paper P is transported downstream in a transport direction. In addition, ink is ejected from the print head 141 onto the paper P. In this regard, an example of a "medium supporting unit" which supports the paper P that is transported along the transport path 20 is configured by the electrostatic transport unit 50.

Figure 2:
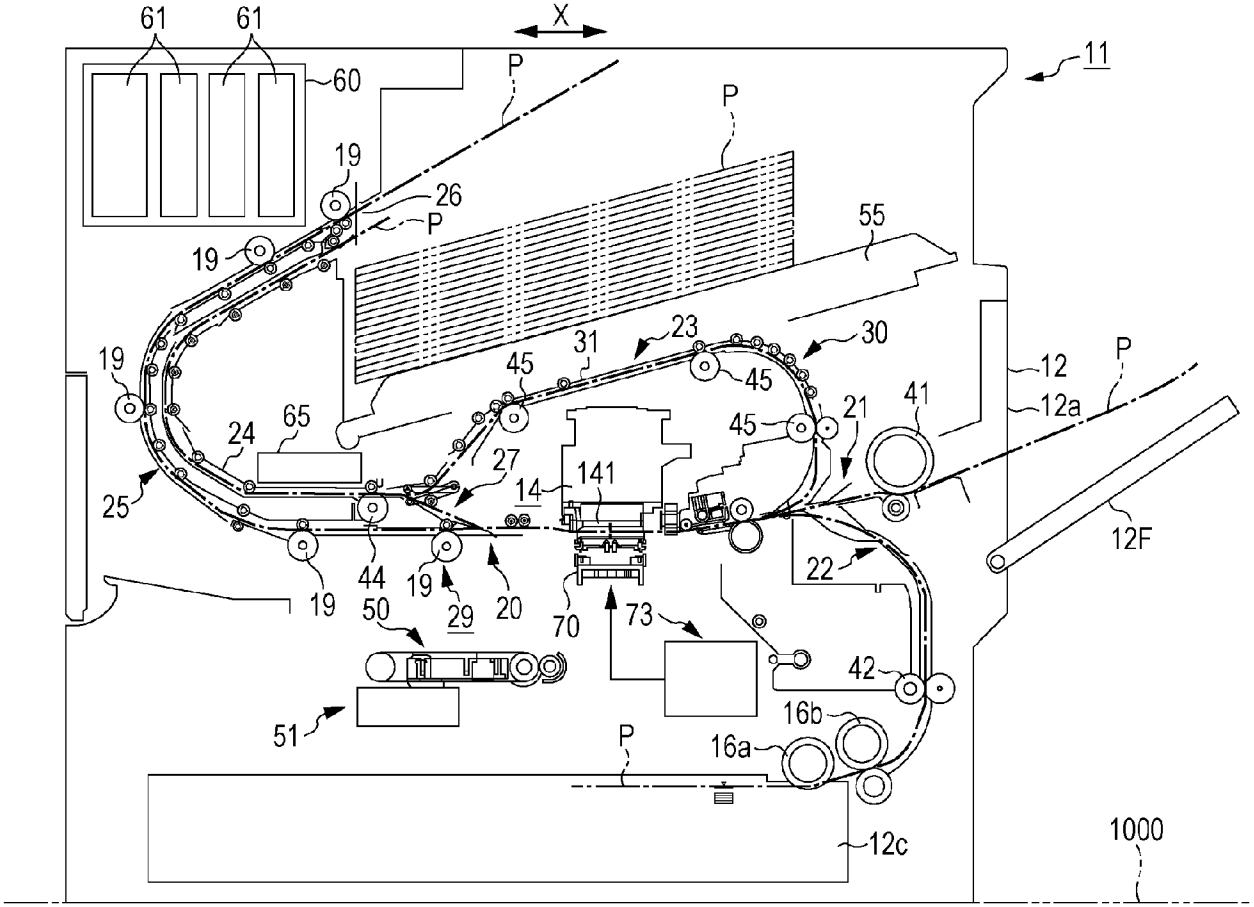
FIG. 2 is a configuration view illustrating a state in which an electrostatic transport unit moves to a retracted position, in the printer.

As illustrated in FIG. 1 and FIG. 2, an electrostatic transport movement device 51 which moves the electrostatic transport unit 50 between two positions of the support position illustrated in FIG. 1 and the retracted position illustrated in FIG. 2 is provided in the printer 11 according to the present embodiment. When the paper P is printed, the electrostatic transport unit 50 is disposed in the support position. Meanwhile, when there is no print request to the paper P or maintenance such as cleaning is performed, the electrostatic transport unit 50 is disposed in the retracted position deviated from the transport path 20.

An openable cover 12F is provided on a side surface (right side surface in FIG. 1) of the case 12, the cover 12F is opened, and thereby an insertion opening 12*a* is exposed. The first medium supply unit 21 includes a first feeding roller pair 41 between which the paper P that is inserted into the case 12 through the insertion opening 12*a* exposed in such a way is interposed. Then, the paper P is fed toward the electrostatic transport unit 50 by rotation of two rollers which configure the first feeding roller pair 41.

In addition, a medium cassette 12*c* in which the paper P that is not printed is set in a stacked state is provided in a lower portion of the case 12 in FIG. 1. The second medium supply unit 22 is a supply unit for feeding the paper P from the medium cassette 12*c*. That is, the second medium supply unit 22 includes a pickup roller 16*a* which sends the paper P on the highest portion in the medium cassette 12*c* outside the medium cassette 12*c*, a separation roller pair 16*b* which prevents multiple papers P from being transported in an overlapped state, and a second feeding roller pair 42 between which one sheet of paper P which passes the separation roller pair 16*b* is interposed. Then, the paper P is fed toward the electrostatic transport unit 50 by rotation of two rollers which configure the second feeding roller pair 42.

The third medium supply unit 23 is a supply unit which leads the paper P whose printing of a sheet surface of one side is completed to the electrostatic transport unit 50 again, when two-sided printing is performed in which two sides of the paper P are printed on. That is, a branch transport path 24 which branches from the transport path 20 is formed on a downstream side of the electrostatic transport unit 50 in a transport direction of the paper. In addition, a branch mechanism 27 which is disposed on a downstream side of the electrostatic transport unit 50 in a transport direction of the paper and switches a transport path of the paper P to the transport path 20 or the branch transport path 24, and a branch transport path roller pair 44 which is disposed in the branch transport path 24 and can rotate in a forward direction and a reverse direction, are provided in the third medium supply unit 23.

In a case where two-sided printing is performed, the paper P whose printing of a sheet surface of one side is completed is led to the branch transport path 24 from the electrostatic transport unit 50 by the branch mechanism 27. At this time, the paper P is transported downstream in a transport direction by rotation of each roller configuring the branch transport path roller pair 44 in a forward direction. In addition, if the rear end of the paper P is led to the branch transport path 24, a roller configuring the branch transport path roller pair 44 rotates in a reverse direction, and thereby the paper P is transported in a reverse direction. Then, the paper P is led to an inverting supply path 31 which is located above the print unit 14 in FIG. 1. Then, the paper P is fed along the inverting supply path 31 by multiple inverting transport roller pairs 45 which are disposed on the inverting supply path 31. By doing so, the paper P is joined to the transport path 20 on an upstream side of the electrostatic transport unit 50 in a transport direction of the paper. Thereafter, the paper P is led to the electrostatic transport unit 50 again. In this way, if the paper P is led to the electrostatic transport unit 50 again, a sheet surface on which printing is completed comes into contact with the electrostatic transport unit 50, and a sheet surface on which printing is not performed faces the print head 141.

In addition, a drying unit 65 that heats the paper P to which the ink ejected from the print head 141 is attached for drying is provided in the printer 11 according to the present embodiment. The drying unit 65 is located on a downstream side (left of the figure) of the print head 141 in a transport direction of the paper, and is disposed above the branch transport path roller pair 44 which is disposed on the branch transport path 24. The branch transport path roller pair 44 is disposed above the print head 141. Accordingly, it can be said that the drying unit 65 is disposed above the print head 141.

The drying unit 65 is configured to send warm air downstream. The warm air which is sent by the drying unit 65 reaches not only the paper P which is transported along the branch transport path 24 but also the paper P which is transported by the discharge mechanism 25. In this way, if the warm air is adsorbed to the paper P, the paper P is heated, and the temperature around the paper P is decreased, and thereby evaporation of the ink adhered to the paper P is promoted.

In a case where a surface to which the printer 11 is installed is referred to as an installation surface 1000, it is assumed that a lateral direction of the figure that is a direction in which the print head 141 and the drying unit 65 are aligned is a "specified direction X", among the directions along the installation surface 1000. In this case, a part of the drying unit 65 and a part of the mounting unit 60 overlap each other in the specified direction X and a width direction of the paper. That is, at least a part of a liquid container 61 which is mounted in the mounting unit 60 is located immediately above the drying unit 65.

As illustrated in FIG. 1 and FIG. 2, a cap 70 which is an example of a space forming member, and a cap drive device 73 which moves the cap 70 are provided in the printer 11 according to the present embodiment. The cap 70 is configured to move between a space forming position illustrated in FIG. 2 and the retracted position illustrated in FIG. 1, according to driving of the cap drive device 73.

Figure 3:
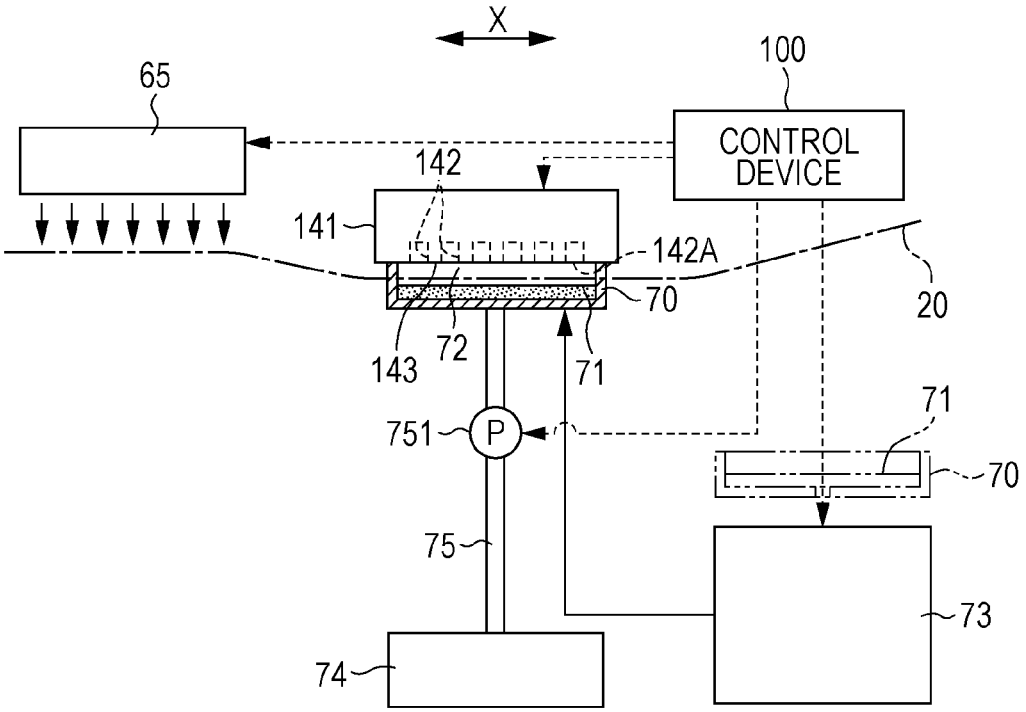
FIG. 3 is a schematic view illustrating a state in which a cap is located at a space forming position, in the printer.

As illustrated in FIG. 3, the cap 70 has a substantially bottom box shape. Then, when the cap 70 moves to the space forming position, the tip (upper end of the figure) of a box shape portion of the cap 70 comes into contact with a nozzle forming surface 143 which is an area in the print head 141 at which multiple nozzles 142 are opened. In addition, when the cap 70 moves to the space forming position and comes into contact with the print head 141, the cap 70 forms a closed space 72 which is a space that is required by an opening 142A of each nozzle 142, together with the nozzle forming surface 143.

A member which comes into contact with the cap 70 at the time of forming the closed space 72 is not limited to the nozzle forming surface 143, and may be a fixed frame which presses a plate member that configures the nozzle forming surface 143, or may be a side surface of the print head 141.

In addition, an ink absorbing material 71 is contained in the cap 70. That is, when the closed space 72 is formed by moving the cap 70 to the space forming position, the ink absorbing material 71 retains the ink, and thus, it is possible to increase the temperature in the closed space 72 to a certain degrees. For this reason, the ink in the nozzle 142 of the print head 141 is prevented from evaporating, and viscosity of the ink in the nozzle 142 is prevented from being increased.

In addition, the space forming position of the cap 70 is set to be above a support position of the electrostatic transport unit 50, and in contrast to this, the retracted position of the cap 70 is set to be below the support position of the electrostatic transport unit 50. In addition, the retracted position of the cap 70 is set on a side opposite to the drying unit 65 across the space forming position in the specified direction X. In addition, when the paper P is printed, the paper P which is transported along the transport path 20 passes through a region between the cap 70 and the drying unit 65 in the retracted position.

The cap 70 is disposed in the space forming position, even when cleaning is performed by discharging the ink through the print head 141. For this reason, the cap 70 is coupled to a discharge path 75 through which the ink that is discharged from the print head 141 is discharged into a waste liquid recovery unit 74. In the example illustrated in FIG. 3, a suction pump 751 is provided in the discharge path 75, and the inside of the closed space 72 is changed into negative pressure by driving of the suction pump 751. As a result, the ink is forcibly discharged into the cap 70 from the print head 141.

Next, a control configuration of the printer 11 according to the present embodiment will be described.

As illustrated in FIG. 1 to FIG. 3, the printer 11 includes a control device 100 which is an example of a control unit, and the control device 100 controls the transport device 29, the print head 141, the drying unit 65, the electrostatic transport movement device 51, and the cap drive device 73. For example, if image data related to an image which is formed in the paper P is input to the control device 100 together with a print request, the control device 100 converts the image data into print data, and controls the ink from the print head 141, based on the print data.

In addition, when the paper P is printed, the more the amount of attached ink per unit area of the paper P, the longer the time which is taken until the paper P is dried. For this reason, in a case where the amount of attached ink per unit area is relatively small, the paper P is quickly dried even though the paper P is not heated by the drying unit 65. Accordingly, it can be determined that the driving of the drying unit 65 is not required. Meanwhile, in a case where the amount of attached ink per unit area is relatively large, the paper P is not sufficiently dried if there is no heating which is performed by the drying unit 65. Accordingly, it can be determined that the drive of the drying unit 65 is required.

Hence, a processing routine which is executed by the control device 100 at the time of controlling the drying unit 65 when the paper P is printed, will be hereinafter described with reference to a flowchart illustrated in FIG. 4. The processing routine is executed when the paper P starts to be printed.

Figure 4:
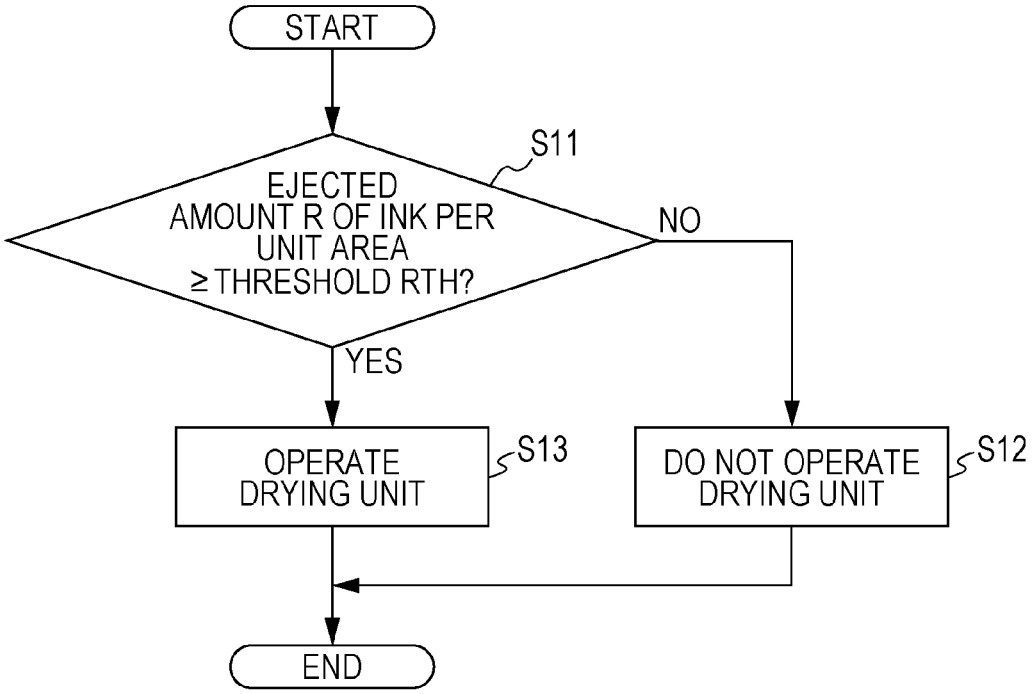
FIG. 4 is a flowchart illustrating a processing routine which is executed when a control device of the printer drives a drying unit.

As illustrated in FIG. 4, the control device 100 calculates the amount R of ejected ink onto the paper P per unit area, based on the print data, and determines whether or not the ejected amount R is equal to or larger than a threshold RTH (step S11). When the ejected amount R is less than the threshold RTH, it can be determined that the amount of attached ink per unit area of the paper P is small. Meanwhile, when the ejected amount R is equal to or larger than the threshold RTH, it can be determined that the amount of attached ink per unit area of the paper P is large.

For this reason, in a case where the ejected amount R is less than the threshold RTH (step S11: NO), the control device 100 does not drive the drying unit 65 (step S12), and terminates the present processing routine. Meanwhile, in a case where the ejected amount R is equal to or larger than the threshold RTH (step S11: YES), the control device 100 drives the drying unit 65 (step S13), and terminates the present processing routine. That is, in the printer 11 according to the present embodiment, the control device 100 performs heating of the paper P using the drying unit, under conditions that the ejected amount R which is the amount of ink that is ejected from the nozzle 142 of the print head 141 to the paper P is equal to or larger than the threshold RTH.

Next, an operation of the printer 11 according to the present embodiment will be described.

As illustrated in FIG. 1, in a situation in which the cap 70 is located at the retracted position and the electrostatic transport unit 50 is located at the support position, the paper P is printed. At this time, when it is determined that the amount of ink attached to the paper P is large, warm air is sent toward the paper P from the drying unit 65.

In this way, when printing of the paper P is performed, the cap 70 is located at the retracted position separated from the drying unit 65. In addition, the electrostatic transport unit 50 is disposed between the cap 70 and the drying unit 65 in a vertical direction. Furthermore, the paper P passes through a region between the cap 70 which is located at the retracted position and the drying unit 65, when printing of the paper P is performed. For this reason, flow of gas can be blocked by the electrostatic transport unit 50 or the paper P, such that the warm air which is sent from the drying unit 65 or air which is warmed by the warm air does not flow toward the cap 70 which is located at the retracted position. Accordingly, the ink which is retained in the ink absorbing material 71 in the cap 70 hardly evaporates.

Thereafter, if printing onto the paper P is terminated and the electrostatic transport unit 50 moves to the retracted position, the cap 70 moves to the space forming position and the closed space 72 at which each nozzle 142 of the print head 141 is opened is formed. At this time, the ink which is absorbed in the ink absorbing material 71 gradually evaporates, and thereby the temperature in the closed space 72 is retained in a relatively high state. Accordingly, liquid components of the ink in each nozzle 142 of the print head 141 are prevented from evaporating. That is, viscosity of the ink in each nozzle 142 is prevented from increasing.

Figure 5:
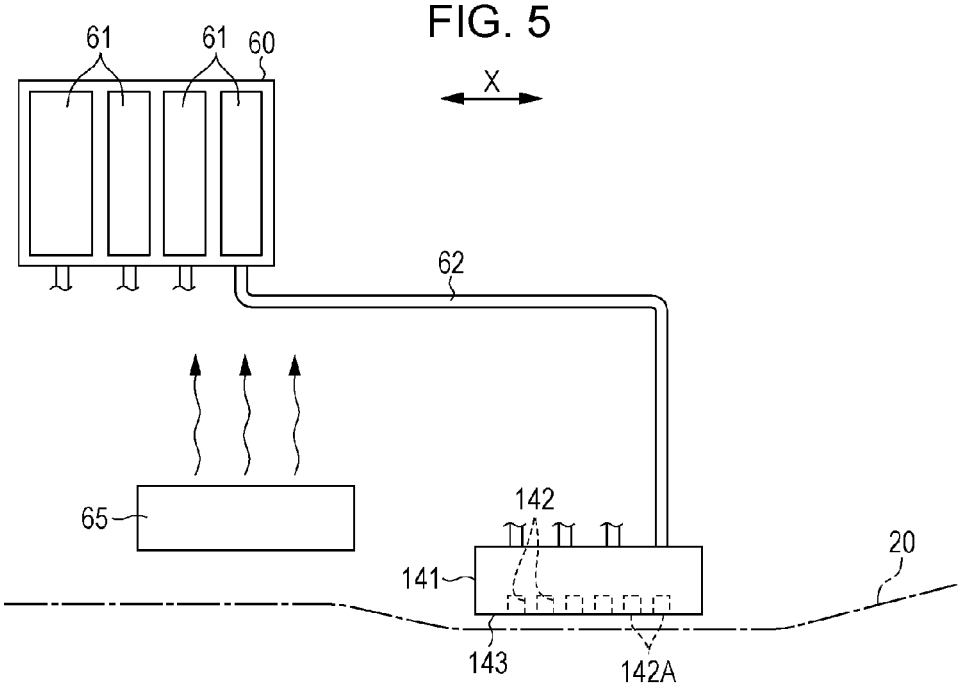
FIG. 5 is a schematic view illustrating a positional relationship between the drying unit and a mounting unit.

As illustrated in FIG. 5, air which is warmed by the heat that is emitted from the drying unit 65 moves upward. Since the liquid container 61 mounted on the mounting unit 60 is disposed on an upper side of the drying unit 65, heat of the warmed air is delivered to the liquid container 61. As a result, the temperature of the ink contained in the liquid container 61 increases.

Here, in the printer 11 which uses ink whose viscosity decreases as the temperature increases, the ink in the liquid container 61 is warmed by the heat which is emitted from the drying unit 65, and thereby the viscosity of the ink decreases. As a result, it is possible to increase flowability of ink flowing through the supply path 62 from the liquid container 61, and to efficiently supply the ink to the print head 141 under a low temperature environment.

Particularly, it is preferable that the mounting unit 60 is disposed such that at least a portion of the liquid container 61 which contains ink whose viscosity decreases as the temperature increases is located immediately above the drying unit 65. In addition to this, if convection of liquid in the liquid container 61 is also urged by delivering the heat from a bottom portion, with regard to the liquid container 61 which contains liquid that contains sedimentation components such as pigment ink, sedimentation containing components is prevented by stirring, and thus, it is possible to prevent print quality from decreasing due to a change of liquid concentration.

As described above, according to the printer 11 of the present embodiment, it is possible to obtain the following effects.

(1) In the printer 11 according to the present embodiment, the retracted position of the cap 70 is further separated from the drying unit 65 than the space forming position. For this reason, when the cap 70 is located at the retracted position, the ink attached to the cap 70 and the ink which is retained in the ink absorbing material 71 in the cap 70 hardly evaporate. Hence, it is possible to set the retracted position of the cap 70 to an appropriate position in which disposition of the drying unit 65 is taken into account.

As a result, in a case where the closed space 72 is formed by disposing the cap 70 in the space forming position, the temperature in the closed space 72 hardly decreases, and thus, it is possible to prevent viscosity of ink from increasing in each nozzle 142 of the print head 141.

(2) In a case where the electrostatic transport unit 50 is disposed in the support position and the cap 70 is disposed in the retracted position, the electrostatic transport unit 50 is located below the drying unit 65 and above the cap 70. For this reason, when the electrostatic transport unit 50 is disposed in the support position, the air which is heated by the drying unit 65 and flows toward the cap 70 located at the retracted position can be blocked by the electrostatic transport unit 50. Hence, it is possible to prevent the ink which is attached to the cap 70 and the ink which is retained in the ink absorbing material 71 in the cap 70 from evaporating, in a situation in which the cap 70 is located at the retracted position.

(3) In addition, when the paper P is printed, the paper P passes through a region between the cap 70 located at the retracted position and the drying unit 65. For this reason, the air which is heated by the drying unit 65 and flows toward the cap 70 located at the retracted position can be blocked by the paper P which is transported along the transport path. Hence, it is possible to prevent the ink which is attached to the cap 70 and the ink which is retained in the ink absorbing material 71 in the cap 70 from evaporating, in a situation in which the cap 70 is located at the retracted position.

(4) In addition, in the printer 11 according to the present embodiment, the nozzle forming surface 143 of the print head 141, that is, the opening 142A of the nozzle 142 is located below the drying unit 65. For this reason, the air warmed by the drying unit 65 is hardly introduced into the nozzle 142 through the opening 142A. For this reason, it is possible to prevent viscosity of the ink in the nozzle 142 which is opened in the nozzle forming surface 143 from increasing.

(5) In addition, when the amount of ink attached to the paper P is small, it can be determined that the paper P may not be heated by the drying unit 65, and thus, the paper P is not heated by the drying unit 65. For this reason, it is possible to prevent a drive frequency of the drying unit 65 from increasing, and thus, it is possible to prevent power consumption of the printer 11 from increasing. Accordingly, it is possible to prevent the cap 70 from being affected by the heat which is emitted from the drying unit 65.

(6) In addition, the air which is heated by the drying unit 65 moves upward. Then, the temperature of the ink in the liquid container 61 which is mounted in the mounting unit 60 increases due to the heated air. In this way, viscosity of the ink decreases due to the increased temperature of the ink. Hence, it is possible to stably supply the ink to the print head 141 from the liquid container 61, even though the ink has high viscosity.

Second Embodiment

Next, a second embodiment in which the liquid ejecting apparatus is embodied will be described with reference to FIG. 6 to FIG. 10. A printer 11 according to the present embodiment is different from that according to the first embodiment in that the printer 11 according to the present embodiment includes an absorbing member and a wiping member as a maintenance member in addition to cap the cap 70. Hence, in the following description, portions different from those according to the first embodiment will be mainly described, the same symbols or reference numerals will be attached to the same member configuration as in the first embodiment, and repeated description thereof will be omitted.

Figure 6:
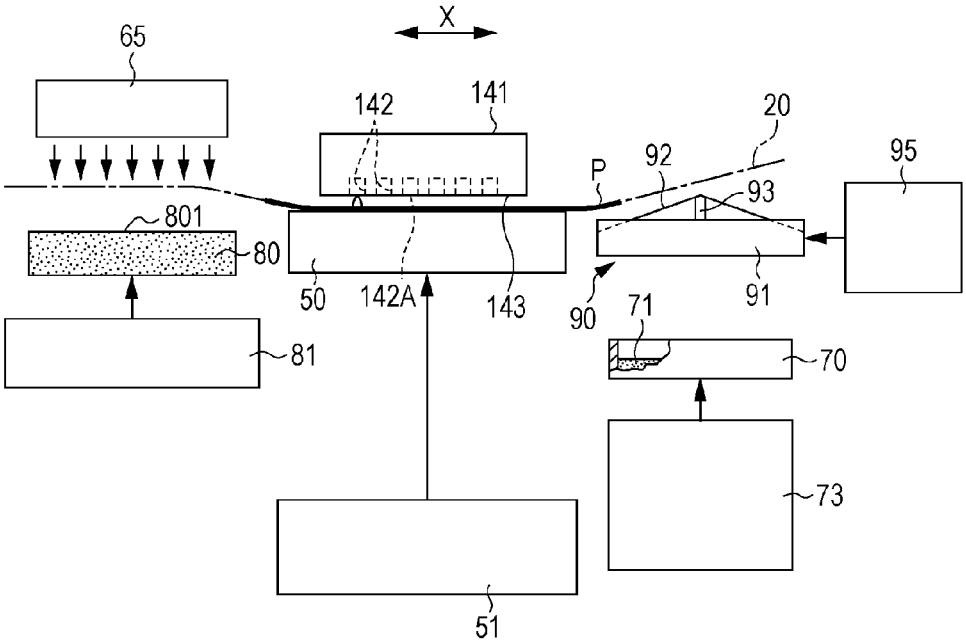
FIG. 6 is a schematic view illustrating a part of the printer as a second embodiment of the liquid ejecting apparatus.

As illustrated in FIG. 6, the printer 11 according to the present embodiment includes an absorbing member 80 which absorbs ink attached to the nozzle forming surface 143 of the print head 141, and an absorbing member drive device 81 which controls movement of the absorbing member 80. In addition, the printer 11 includes a wiping device 90 which wipes the nozzle forming surface 143 and a wiping drive device 95 which controls movement of the wiping device 90. The absorbing member 80, the wiping device 90, and the cap 70 are disposed below the paper P which is supported by the electrostatic transport unit 50, when the paper P is printed.

Figure 7:
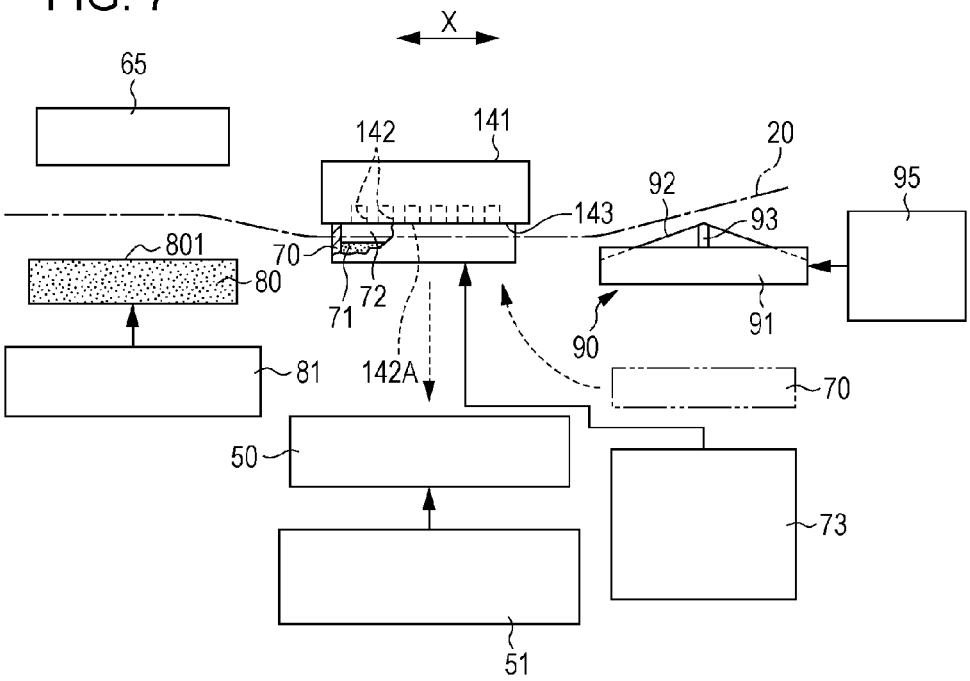
FIG. 7 is a schematic view illustrating a state in which a cap is located at a space forming position, in the printer.

In addition, as illustrated in FIG. 6 and FIG. 7, when the cap 70 is moved from the retracted position to the space forming position, the electrostatic transport unit 50 is moved from the support position to the retracted position by drive of the electrostatic transport movement device 51. In the examples illustrated in FIG. 6 and FIG. 7, the electrostatic transport unit 50 moves from the support position toward a lower side.

When the electrostatic transport unit 50 completes movement to the retracted position, or immediately before the movement is completed, the cap drive device 73 starts drive, and the cap 70 moves from the retracted position to the space forming position. Then, the cap 70 which is moved to the space forming position forms the closed space 72 at which each nozzle 142 of the print head 141 is opened. Also in the printer 11 according to the present embodiment, the retracted position of the cap 70 is set to a position which is further separated from the drying unit 65 than the space forming position of the cap 70, in the same manner as in the first embodiment.

Figure 8:
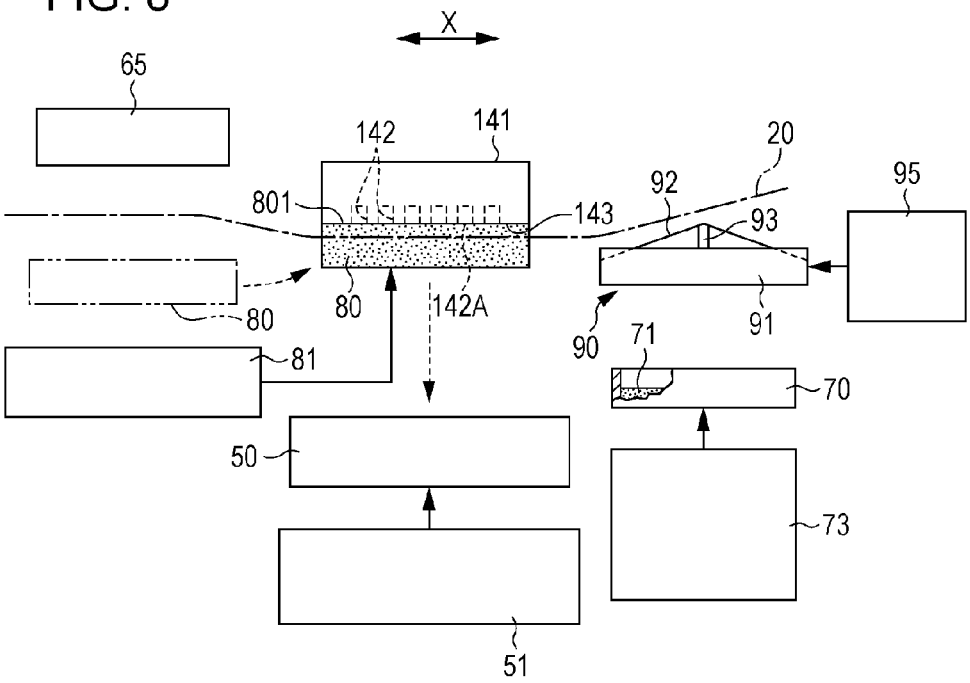
FIG. 8 is a schematic view illustrating a state in which an absorbing member is located at a contact position, in the printer.

As illustrated in FIG. 6 and FIG. 8, the absorbing member 80 can move between a contact position illustrated in FIG. 8 and the retracted position illustrated in FIG. 6, according to driving of the absorbing member drive device 81. The absorbing member 80 is configured to be able to absorb ink. For example, a porous member having multiple voids can be used as the absorbing member 80. In addition, the absorbing member 80 includes a contact surface 801 which can come into contact with the nozzle forming surface 143 of the print head 141, and an area of the contact surface 801 is approximately the same as the nozzle forming surface 143.

If the absorbing member 80 moves to the contact position, the contact surface 801 of the absorbing member 80 comes into contact with the nozzle forming surface 143 of the print head 141. More specifically, the absorbing member 80 is pressed against the nozzle forming surface 143. Accordingly, the ink which is attached to the nozzle forming surface 143 is absorbed into the absorbing member 80. Then, if the ink is completely absorbed into the absorbing member 80 from the nozzle forming surface 143, the absorbing member 80 is moved from the contact position to the retracted position by the drive of the absorbing member drive device 81. Accordingly, contact between the absorbing member 80 and the nozzle forming surface 143 is released.

A member, which comes into contact with the absorbing member 80, for absorbing liquid such as ink is not limited to the nozzle forming surface 143, and may be a fixed frame which presses a plate member that configures the nozzle forming surface 143, or may be a side surface of the print head 141.

The retracted position of the absorbing member 80 is set to a place closer to the drying unit 65 than the contact position of the absorbing member 80. More specifically, the retracted position of the absorbing member 80 is further separated from the drying unit 65 than the contact position in a vertical direction, but is set to a position closer to the drying unit 65 than the contact position in the specified direction X. That is, the retracted position of the absorbing member 80 is set to be below the drying unit 65 in a vertical direction, and a straight line distance from the retracted position of the absorbing member 80 to the drying unit 65 is shorter than a straight line distance from the contact position of the absorbing member 80 to the drying unit 65. For this reason, when the absorbing member 80 is located at the retracted position, the absorbing member 80 is easily heated by the warm air which is sent from the drying unit 65 or the heat which is emitted from the drying unit 65.

Figure 9:
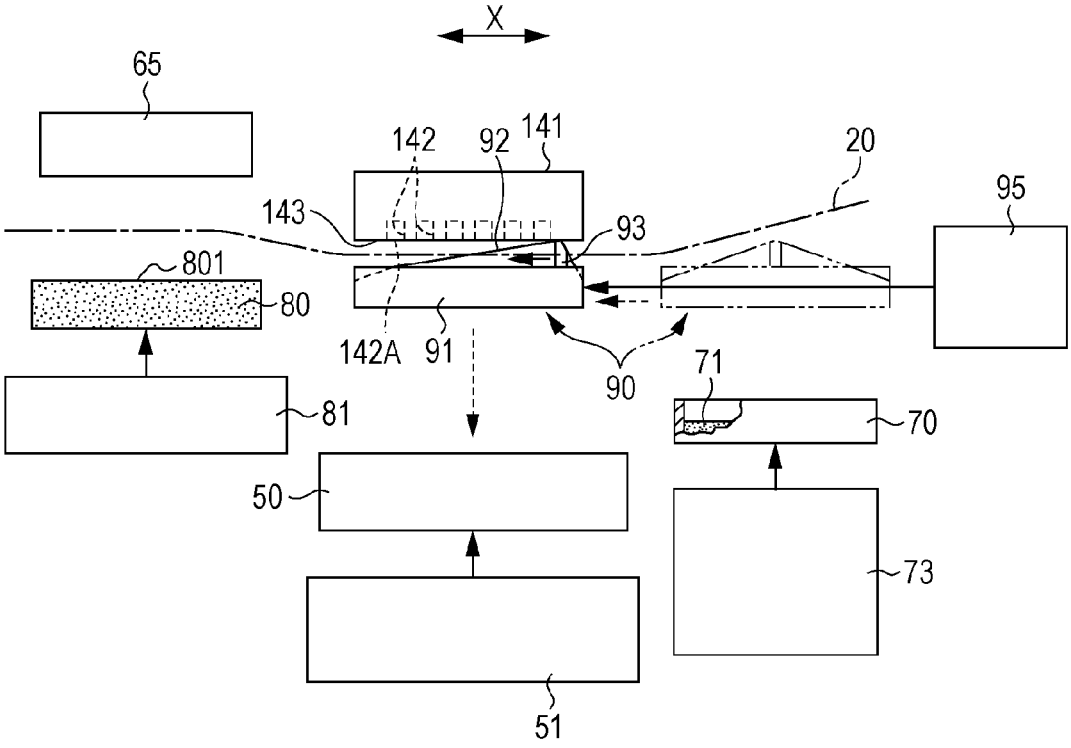
FIG. 9 is a schematic view illustrating a state in which a wiping member is located at a wiping position, in the printer.

As illustrated in FIG. 6 and FIG. 9, the wiping device 90 is located at a position in which the nozzle forming surface 143 including an area in the print head 141 at which the nozzle 142 is opened is wiped by drive of the wiping drive device 95, and can move between a position illustrated in FIG. 9 and a position illustrated in FIG. 6.

Figure 10:
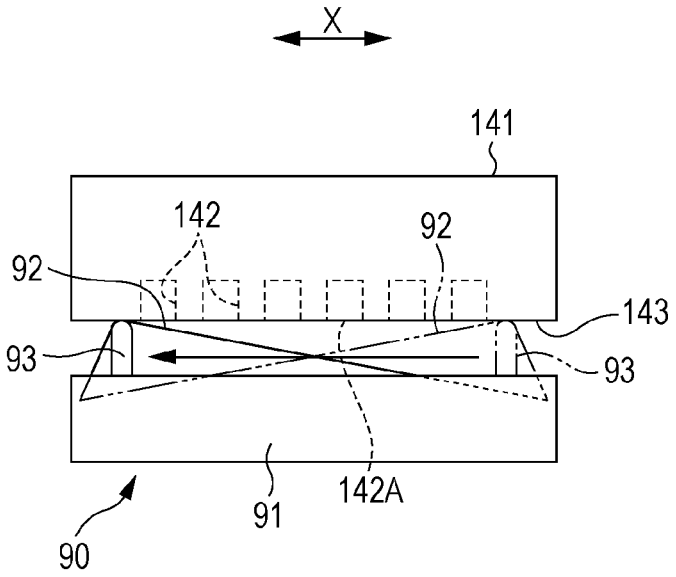
FIG. 10 is an operational view illustrating a state in which the wiping member wipes a nozzle forming surface, in the printer.

As illustrated in FIG. 9 and FIG. 10, the wiping device 90 includes an apparatus main body 91, a wiping member 92 which is retained in a wet state, and a pressing member 93 which presses the wiping member 92 to the nozzle forming surface 143 of the print head 141. In this case, it is preferable that the wiping member 92 includes a member which can absorb liquid such as a non-woven fabric or porous material, and enters a wet state by containing the absorbed liquid (impregnating liquid). The liquid (impregnating liquid) which is contained in the wiping member 92 includes components which softens or dissolves components contained in the solidified ink, such as solvent (water, if the solvent is water-based ink) components of the ink (that is, ink which is emitted from the print head 141) which is attached to the nozzle forming surface 143. In addition, the wiping device 90 may have a configuration in which a region including not only the nozzle forming surface 143 but also a fixed frame for pressing a plate member that configures the nozzle forming surface 143 can be wiped by the wiping member 92.

In addition, when the nozzle forming surface 143 is wiped by the wiping member 92, the pressing member 93 moves in a direction (for example, a lateral direction in FIG. 10) along the nozzle forming surface 143. As the pressing member 93 moves in this way, the wiping member 92 can wipe the entire area of the nozzle forming surface 143. Hence, a position of the wiping member 92 illustrated in FIG. 9 corresponds to a "wiping position" which is disposed when the nozzle forming surface 143 is wiped, and a position of the wiping member 92 illustrated in FIG. 6 corresponds to a "retracted position" which is separated from the nozzle forming surface 143.

The retracted position of the wiping member 92 is set to a position which is further separated from the drying unit 65 than the wiping position of the wiping member 92. More specifically, the retracted position of the wiping member 92 is set to a position which is further separated from the drying unit 65 than the wiping position in the specified direction X. That is, the retracted position of the wiping member 92 is located at a side opposite to the drying unit 65 in which the print head 141 is interposed therebetween in the specified direction X.

Next, operations on the absorbing member 80 and the wiping device 90 will be mainly described, among operations of the printer 11 according to the present embodiment. The operation on the cap 70 is the same as that of the aforementioned first embodiment, and thus, description thereof will be omitted.

When the paper P is printed, the electrostatic transport unit 50 moves to the support position, and meanwhile, the absorbing member 80 moves to the retracted position thereof. The retracted position of the absorbing member is located immediately below the drying unit 65, and is closer to the drying unit 65 than to the contact position. For this reason, the absorbing member 80 located at the retracted position is heated by the warm air which is sent from the drying unit 65 or the heat which is emitted from the drying unit 65.

In this way, as the absorbing member 80 is warmed or temperature around the absorbing member 80 is decreased by an increase of temperature, the ink absorbed in the absorbing member 80 evaporates from a surface thereof, and during of the absorbing member 80 is promoted.

In addition, as printing onto the paper P is terminated, the electrostatic transport unit 50 moves from the support position to the retracted position, and thereafter, the absorbing member 80 moves to the contact position and comes into contact with the print head 141. At this time, the surface of the absorbing member 80 is dry, and thereby the ink attached to the nozzle forming surface 143 is quickly absorbed into the absorbing member 80 by capillary force of the voids which are opened in a surface thereof.

In addition, in a case where the paper P is printed, the wiping member 92 is disposed at the retracted position of the wiping member, the electrostatic transport unit 50 is disposed at the support position, and thereby, the warm air which is sent from the drying unit 65 or the heat which is emitted from the drying unit 65 is blocked by the electrostatic transport unit 50 or the paper P which is transported along the transport path. For this reason, the wiping member 92 located at the retracted position is hardly heated. As a result, the impregnating liquid which is contained in the wiping member 92 is prevented from evaporating, and thus, the wet state of the wiping member 92 is easily retained.

Hence, as printing onto the paper P is terminated, the electrostatic transport unit 50 moves from the support position to the retracted position, and thereafter, when the wiping member 92 moves to the wiping position and wipes the nozzle forming surface 143, the wiping member 92 can perform wiping while wetting the nozzle forming surface 143 using the impregnating liquid which is contained therein. Accordingly, it is possible to efficiently remove contaminants by dissolving the matters attached to the nozzle forming surface 143 using the impregnating liquid, and to prevent the nozzle forming surface 143 from being damaged due to the fact that the attached matters are removed in a dry state.

As described above, the printer 11 according to the present embodiment can obtain the following effects, in addition to the same effects as the effects (1) to (6) of the first embodiment.

(7) In the printer 11 according to the present embodiment, the retracted position of the absorbing member 80 is set to a position closer to the drying unit 65 than the contact position. For this reason, when the absorbing member 80 is located at the retracted position, the ink from the absorbing member 80 easily evaporates. As a result, the amount of ink contained in the absorbing member 80 is reduced at a point of time when the absorbing member 80 moves to the contact position, and the ink attached to the nozzle forming surface 143 is easily absorbed into the absorbing member 80. Hence, it is possible to set the retracted position of the absorbing member 80 to an appropriate position in which disposition of the drying unit 65 is taken into account.

(8) In the printer 11 according to the present embodiment, the retracted position of the wiping member 92 is set to a position further separated from the drying unit 65 than the wiping position. For this reason, when the wiping member 92 is located at the retracted position, the liquid components which are retained in the wiping member 92 hardly evaporate. As a result, it is possible to prevent wiping performance from being reduced, when the nozzle forming surface 143 of the print head 141 is wiped by the wiping member 92. Hence, it is possible to set the retracted position of the wiping member 92 to an appropriate position in which disposition of the drying unit 65 is taken into account.

(9) In a case where the electrostatic transport unit 50 is disposed at the support position and the wiping member 92 is disposed at the retracted position, the electrostatic transport unit 50 is located between the drying unit 65 and the wiping member 92 (wiping device 90). For this reason, when the electrostatic transport unit 50 is disposed in the support position, the air which is heated by the drying unit 65 and flows toward the wiping member 92 located at the retracted position can be blocked by the electrostatic transport unit 50. Hence, it is possible to easily maintain the wet state of the wiping member 92, in a situation in which the wiping member 92 is located at the retracted position.

(10) In addition, when the paper P is printed, the paper P passes through a region between the wiping member 92 located at the retracted position and the drying unit 65. For this reason, the air which is heated by the drying unit 65 and flows toward the wiping member 92 located at the retracted position can be blocked by the paper P which is transported along the transport path. Hence, it is possible to easily maintain the wet state of the wiping member 92, in a situation in which the wiping member 92 is located at the retracted position.

Each embodiment described above may be modified as follows.

In a case where liquid which contains sedimentation components, such as pigment ink is used as liquid which is ejected from the print head 141, sedimentation of the contained components is performed and thereby temperature of the liquid can change. For this reason, a circulation flow path for circulating ink may be provided in a supply path from the liquid container 61 to the print head 141. The circulation flow path may be provided in the middle of a supply flow path between the print head 141 and the liquid container 61, may be used as a return flow path through which the ink is returned from the middle of the supply flow path to the liquid container 61, may be used as a return flow path through which the ink returned from the print head 141 to the middle of the supply flow path, and may be used as a return flow path through which the ink is returned from the print head 141 to the liquid container 61.

In this case, if at least a part of the circulation flow path is disposed immediately above the drying unit 65, temperature of the ink which flows through the circulation flow path can be increased by the heat which is emitted from the drying unit 65. Accordingly, fluidity of ink can increase or agitation can be promoted by convection. As a result, it is possible to prevent power required for circulation of the ink from increasing.

That is, if a sub-tank which temporarily stores the ink in a portion of a supply path (including the circulation flow path) of ink from the liquid container 61 to the print head 141 or in the middle of the supply path is disposed at a position (for example, immediately above the drying unit 65 or position that warm air reaches) in which the heat of the drying unit 65 is easily delivered, without being limited to the liquid container 61, it is possible to increase fluidity of the ink or to prevent sedimentation of the contained components.

In addition to this, in a case where a filter for removing foreign matters or bubbles in the middle of the supply path is disposed, if a portion including the filter is disposed at a position (for example, immediately above the drying unit 65 or position that warm air reaches) in which the heat of the drying unit 65 is easily delivered, viscosity of the ink is decreased by the heat of the drying unit 65. Accordingly, it is possible to reduce pressure loss when the ink passes through the filter, and to prevent the matter attached to the filter from being solidified.

If a part of the supply path 62 is located immediately above the drying unit 65, the mounting unit 60 may be disposed at a position different from the drying unit 65 in the specified direction X.

In a printer or the like which includes the print head 141 of a line head type, the liquid container 61 which contains ink may be provided outside the case 12. In the printer, a part of the supply path 62 for supplying the ink from the liquid container 61 to the print head 141 may be located at an upper side region (that is, immediately above) of the drying unit 65. For example, a sub-tank which supplies ink from the liquid container 61 may be disposed on an upper side of the drying unit 65.

In the second embodiment, after wiping of the nozzle forming surface 143 which is performed by the wiping member 92 in a wet state is terminated, the absorbing member 80 may come into contact with the nozzle forming surface 143. According to this configuration, after foreign matters or liquids which are fixed to the nozzle forming surface 143 are raked into a corner of the nozzle forming surface 143 by wet wiping that is performed by the wiping member 92 in a wet state, the raked foreign matters or liquids can be removed after being dried by the absorbing member 80.

If the drying unit can heat the paper P or gas around the paper, the drying unit may have other configurations in addition to the configuration which sends warm air. For example, the drying unit may be configured to have a heating roller. In this case, the paper P can be heated by pressing the heating roller to the paper P.

The drying unit may be divided into two units which are a drying unit dedicated to the paper that is transported along the branch transport path 24, and a drying unit dedicated to the paper that is transported by the discharge mechanism 25. In this case, it is preferable that the two types of drying units are selectively used according to transport aspects of the paper P which is printed by the print head 141.

The drying unit 65 may be driven when the paper P is printed, regardless of the amount of attached ink per unit area of the paper P.

In a case where a distance between the drying unit 65 and the print head 141 in the specified direction X is long to a certain degree, a part of the drying unit 65 may be disposed below the nozzle forming surface 143.

If the retracted position of the cap 70 is further separated from the drying unit 65 than the space forming position, the retracted position of the cap 70 can be set to an arbitrary position. For example, the retracted position of the cap 70 may be disposed such that the paper P does not pass through a region between the retracted position and the drying unit 65.

The ink absorbing material 71 may not be provided in the cap 70. Even in this case, the ink is retained in the cap 70 by attaching the ink in the inner wall of the cap 70 or by keeping the ink in a groove formed in a bottom wall thereof, and thereby it is possible to prevent the nozzle 142 from being dried, when the cap 70 forms the closed space 72.

Figure 11:
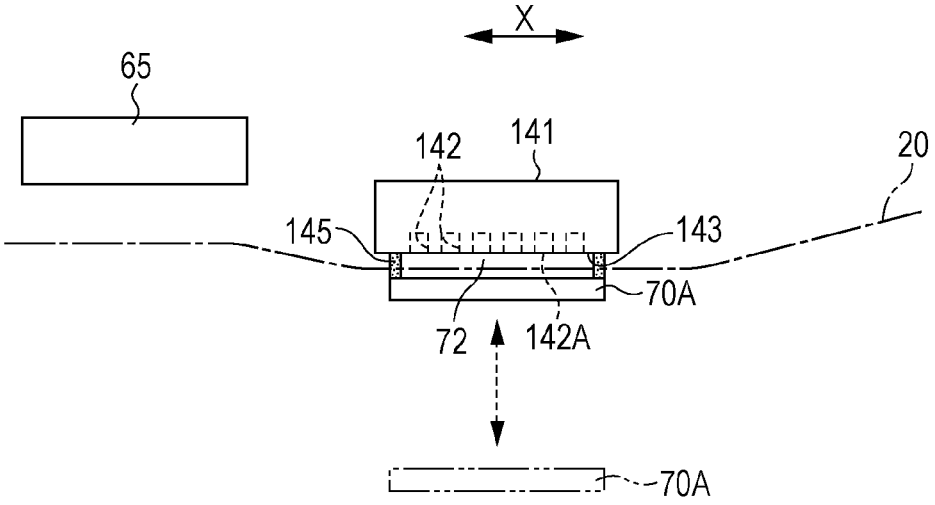
FIG. 11 is an operational view illustrating a state in which a space forming member moves from a retracted position to the space forming position, in a printer as another embodiment of the liquid ejecting apparatus.

If a space forming member can retain liquid, the space forming member may have other configuration other than the cap 70. For example, as illustrated in FIG. 11, a space forming member 70A may have a plate shape. In this case, a seal member 145 having a ring shape may be provided in the print head 141 so as to surround the opening 142A of the nozzle 142. According to this configuration, the space forming member 70A moves to the space forming position thereby coming into contact with the seal member 145. Accordingly, it is possible to form the closed space 72 at which each nozzle 142 is opened. According to this configuration, it is also possible to retain liquid in a groove or a concave portion, for example, by forming the groove or the concave portion in an upper surface of the space forming member 70A of a plate shape.

In each embodiment, cleaning which forcibly discharges ink from the print head 141 is performed by generating negative pressure in the closed space 72. However, the cleaning is not limited to this, and may be performed by using other methods. For example, the cleaning which discharges the ink in the closed space 72 may be performed by driving a pressing pump which is provided on an upstream side of the nozzle 142. Alternatively, in a case where a circulation flow path is provided in a supply path from the liquid container 61 to the print head 141, cleaning which discharges liquid from the nozzle 142 may be performed by driving a pump for circulating the liquid through the circulation flow path.

In a case where the ink retained in the cap 70 evaporates, it is possible to supplement ink in the cap 70 by ejecting the ink into the cap 70 from the print head 141. In the same manner, in a case where the wiping member 92 is dried, the wiping member 92 can be returned to a wet state by ejecting the ink. However, as the wiping member 92 comes into wet contact with the nozzle forming surface 143, components contained in the ink which is solidified by drying can damage the nozzle forming surface 143. At this time, solvent components of the evaporated ink are used for moisturizing of the nozzle 142 which is performed by the cap 70, and thus, the ink which is used for printing is reduced, but the moisturizing can be performed. Accordingly, in the second embodiment, the retracted position of the wiping member 92 may be set to a farther position from the drying unit 65 than the retracted position of the cap 70.

In the second embodiment, when the nozzle forming surface 143 of the print head 141 is wiped, the wiping device 90 may move in a direction along the nozzle forming surface 143 in a state where the wiping member 92 comes into contact with the nozzle forming surface 143. In this case, the pressing member 93 which relatively moves with respect to the print head 141 and the wiping member 92 may not be provided. In addition, in this case, the wiping member 92 may be replaced by a sponge which can absorb liquid (impregnating liquid), a roller which is configured by a porous material whose outer peripheral surface can absorb the liquid (impregnating liquid), or the like. In addition, in this case, it may be configured that a storage unit which stores impregnating liquid in a base end portion of sponge is disposed, and a portion which comes into contact with the nozzle forming surface 143 can be modified by rotating a roller.

In the second embodiment, if the retracted position of the wiping member 92 is located at a position further separated from the drying unit 65 than the wiping position, the retracted position of the wiping member 92 may be set to an arbitrary position. For example, the retracted position of the wiping member 92 may be a position in which the paper P does not pass through a region between the retracted position and the drying unit 65.

In the second embodiment, wiping of the nozzle forming surface 143 is performed by displacing the contact position of the wiping member 92 in the nozzle forming surface 143 from one side to another side in the specified direction X. However, the wiping of the nozzle forming surface 143 is not limited to this, and may be performed by displacing the contact position in a width direction of the paper.

In the second embodiment, if the retracted position of the absorbing member 80 is located at a closer position to the drying unit 65 than the contact position, the retracted position of the absorbing member 80 may be set to an arbitrary position. For example, the retracted position of the absorbing member 80 may be a position immediately above the drying unit 65.

In the second embodiment, if the absorbing member 80 is provided, the absorbing member 80 may have a configuration in which at least one of the wiping device 90 and the cap 70 is not included. In addition, if the retracted position of the absorbing member is set to a position closer to the drying unit 65 than the contact position of the absorbing member, the retracted position of the wiping member may be set to a position closer to the drying unit 65 than the wiping position of the wiping member. In addition, if the retracted position of the absorbing member is set to a position closer to the drying unit 65 than the contact position of the absorbing member, the retracted position of the cap may be set to a position closer to the drying unit 65 than the space forming position of the cap.

In the second embodiment, if the wiping device 90 is provided, the wiping device 90 may have a configuration in which at least one of the absorbing member 80 and the cap 70 is not included. In addition, if the retracted position of the wiping member is set to a position further separated from the drying unit 65 than the wiping position of wiping member, the retracted position of the absorbing member may be set to a position further separated from the drying unit 65 than the contact position of the absorbing member. In addition, if the retracted position of the wiping member is set to a position further separated from the drying unit 65 than the wiping position of the wiping member, the retracted position of the cap may be set to a position closer to the drying unit 65 than the space forming position of the cap.

In the second embodiment, if the retracted position of the cap is set to a position further separated from the drying unit 65 than the space forming position of the cap, the retracted position of the absorbing member may be set to a position further separated from the drying unit 65 than the contact position of the absorbing member. In addition, if the retracted position of the cap is set to a position further separated from the drying unit 65 than the space forming position of the cap, the retracted position of the wiping member may be set to a position closer to the drying unit 65 than the wiping position of the wiping member.

The medium supporting unit is disposed at a position facing the nozzle forming surface 143 of the print head 141, if the medium supporting unit has a configuration in which a medium such as the paper P which is transported along the transport path can be supported, the medium supporting unit may be a support unit which is arbitrarily configured not to include a charging belt.

The print unit 14 may be a head having a long ruler shape which extends in a width direction of the paper, as a print head of a line-head type, and may be configured to include multiple print heads. In addition, in a case where the print unit 14 is configured to include multiple print heads, a space forming member such as the cap 70 may be provided in each print head or each nozzle group which ejects the same liquid in each print head.

In addition, in a case where the print unit 14 is configured to include multiple print heads, the absorbing member 80 may be configured to include a large contact surface 801 which can come into contact with the nozzle forming surface of all the print heads. In addition, the absorbing member 80 may be provided in each print head or each nozzle group which ejects the same liquid in each print head.

In addition, in a case where the print unit 14 is configured to include multiple print heads, the wiping device 90 may be configured to include a large wiping member which can wipe the nozzle forming surface of all the print heads. In addition, in a case where multiple print heads or nozzle groups which eject the same liquid are lined up in a direction intersecting a wiping direction in which the wiping member wipes the nozzle forming surface, the wiping device 90 may be provided in each print head or each nozzle group which are lined up in the interesting direction.

The printer 11 may be employed in a device which ejects ink onto other media other than the paper P, such as a plastic film.

The liquid ejecting apparatus may eject or spray other liquid (liquid material in which particles of a functional material are dispersed or mixed, including a flow shape material such as gel) other than the ink. For example, the liquid ejecting apparatus may eject a liquid material including a dispersed or dissolved material, such as an electrode material or a color material (pixel material) which is used for manufacturing a liquid crystal display, an electroluminescence (EL) display, and a surface emitting display. In addition, the liquid ejecting apparatus may be a device which ejects biological organic material that is used for manufacturing a biochip, or a device which ejects liquid that is configured by a sample which is used as a precision pipette. Furthermore, the liquid ejecting apparatus may be a device which ejects lubricating oil into a precision apparatus such as a clock or a camera using a pin point, or a device which ejects a transparent resin liquid such as an ultraviolet curing resin onto a substrate so as to form a micro-hemispherical lands (optical lens) or the like which is used for an optical communication element or the like. In addition, the liquid ejecting apparatus may be a device which ejects etching liquid such as acid or alkali so as to etch the substrate or the like, or a device which ejects a flow shape material such as gel (for example, physical gel).

The entire disclosure of Japanese Patent Application No. 2015-128824, filed Jun. 26, 2015 is expressly incorporated by reference herein.

What is claimed is:

1. A liquid ejecting apparatus comprising:

a medium supporting unit which supports a medium that is transported along a transport path;

a liquid ejecting head which includes a nozzle for ejecting liquid onto a medium that is supported by the medium supporting unit;

a heating part which heats the medium;

a wiping member in a wet state which wipes an area in the liquid ejecting head at which the nozzle is opened by relatively moving with respect to the liquid ejecting head; and a space forming member which forms a closed space at which the nozzle is opened, wherein, while the liquid ejecting head ejects the liquid onto the medium, the space forming member is located in a first retracted position, wherein the heating part is disposed on an downstream side from the liquid ejecting head in a transport direction in which the medium is transported, wherein the first retracted position is located on an upstream side from the liquid ejecting head in the transport direction, and wherein the medium supporting unit is configured to move between a support position below the liquid ejecting head in which the medium supporting unit supports the medium that is transported and a second retracted position which is separated from the transport path, wherein the heating part is disposed above an opening of the nozzle, wherein the wiping member is configured to move between a wiping position in which the wiping member is disposed when wiping the area, and a standby position which is further separated from the liquid ejecting head and the heating part than wiping position, and wherein the retracted position of the space forming member is below the standby position of the wiping member.

2. The liquid ejecting apparatus according to claim 1, wherein the transport path is configured such that the medium passes through a region between the retracted position and the heating part.

3. The liquid ejecting apparatus according to claim 1, further comprising:

a control unit which controls the heating part, wherein the control unit performs heating using the heating part, under the condition that the amount of liquid which is ejected from the nozzle onto the medium is equal to or larger than a threshold.

4. The liquid ejecting apparatus according to claim 1, further comprising:

a mounting unit in which a liquid container that contains liquid which is supplied to the liquid ejecting head is mounted, wherein the mounting unit is disposed such that at least a part of the liquid container which is mounted in the mounting unit is located immediately above the heating part.

5. The liquid ejecting apparatus according to claim 1, wherein the first retracted position is further separated from the heating part than a space forming position in which the space forming member forms the closed space to thereby at least partially prevent hot air from the heating part drying liquid in the space forming member.

6. The liquid ejecting apparatus according to claim 1, wherein the space forming member is configured to be capable of suctioning liquid from the nozzle.

7. The liquid ejecting apparatus according to claim 1, wherein the first retracted position is located on an opposite side to the heating part with respect to the liquid ejecting head.

8. A liquid ejecting apparatus comprising:

a medium supporting unit which supports a medium that is transported along a transport path;

a liquid ejecting head which includes a nozzle for ejecting liquid onto a medium that is supported by the medium supporting unit;

a heating part which heats the medium;

a space forming member which forms a closed space at which the nozzle is opened; and a wiping member in a wet state which wipes an area in the liquid ejecting head at which the nozzle is opened by relatively moving with respect to the liquid ejecting head, wherein, while the liquid ejecting head ejects the liquid onto the medium, the space forming member is located in a retracted position on an opposite side to the heating part with respect to the liquid ejecting head, and the wiping member is located in a standby position on an opposite side to the heating part with respect to the liquid ejecting head and above the retracted position.

9. A liquid ejecting apparatus comprising:

a medium supporting unit which supports a medium that is transported along a transport path;

a liquid ejecting head which includes a nozzle for ejecting liquid onto a medium that is supported by the medium supporting unit;

a heating part which heats the medium;

a wiping member in a wet state which wipes an area in the liquid ejecting head at which the nozzle is opened by relatively moving with respect to the liquid ejecting head; and a space forming member which forms a closed space at which the nozzle is opened in a space forming position, wherein, in response to the medium supporting unit moves to a position facing the liquid ejecting head, the space forming member moves from the space forming position to a first retracted position, wherein the heating part is disposed on an downstream side from the liquid ejecting head in a transport direction in which the medium is transported, wherein the first retracted position is located on an upstream side from the liquid ejecting head in the transport direction, and wherein the medium supporting unit is configured to move between a support position below the liquid ejecting head in which the medium supporting unit supports the medium that is transported and a second retracted position which is separated from the transport path, wherein while the liquid ejecting head ejects the liquid onto the medium the wiping member is located in a standby position on an opposite side to the heating part with respect to the liquid ejecting head, and above the first retracted position of the space forming member.

10. The liquid ejecting apparatus according to claim 6, wherein the first retracted position is located on an opposite side to the heating part with respect to the liquid ejecting head.

* * * * *